US010573236B1

(12) United States Patent
Gao et al.

(10) Patent No.: US 10,573,236 B1
(45) Date of Patent: Feb. 25, 2020

(54) DISPLAYS WITH LUMINANCE ADJUSTMENT CIRCUITRY TO COMPENSATE FOR GATE LINE LOADING VARIATIONS

(71) Applicant: Apple Inc., Cupertino, CA (US)

(72) Inventors: Shengkui Gao, San Jose, CA (US); Graeme M. Williams, Cupertino, CA (US); Haifeng Li, Campbell, CA (US); Mohammad Ali Jangda, Cupertino, CA (US); Paolo Sacchetto, Cupertino, CA (US); Pierre-Yves Emelie, Mountain View, CA (US); Shyuan Yang, Burlingame, CA (US); Sinan Alousi, Campbell, CA (US); Tsung-Ting Tsai, Cupertino, CA (US); Warren S. Rieutort-Louis, Cupertino, CA (US); Weijun Yao, Saratoga, CA (US); Yafei Bi, Los Altos Hills, CA (US); Yue Jack Chu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/283,473

(22) Filed: Feb. 22, 2019

(30) Foreign Application Priority Data

Feb. 1, 2019 (CN) ..... 2019 1 0105225

(51) Int. Cl.
*G09G 3/3233* (2016.01)
*G09G 3/20* (2006.01)
*G09G 3/3266* (2016.01)

(52) U.S. Cl.
CPC ..... *G09G 3/3233* (2013.01); *G09G 3/2044* (2013.01); *G09G 3/3266* (2013.01);
(Continued)

(58) Field of Classification Search
CPC ..... G09G 3/3233
(Continued)

(56) References Cited

U.S. PATENT DOCUMENTS 7,495,646 B2 2/2009 Kawabe et al.
8,610,650 B2 12/2013 Somerville
(Continued)

FOREIGN PATENT DOCUMENTS

CN 205354618 U 6/2016
CN 106991990 A 7/2017
(Continued)

*Primary Examiner* — Long D Pham
(74) *Attorney, Agent, or Firm* — Treyz Law Group, P.C.; Joseph F. Guihan

(57) ABSTRACT

A display may have an array of pixels. Due to the presence of a notch in the display, the display may have some rows that are shorter than other rows in the display, and accordingly different gate line loading. To account for the gate line loading variations, the display driver circuitry may have gate driver circuits that provide different gate line signals to different rows of pixels within the display. In other arrangement, luminance adjustment circuitry may receive image data and generate corresponding compensated image data to account for gate line loading variations between rows of pixels in the display. The image data may be compensated based on the location of the pixel, the gray level of the image data, the display brightness, and/or temperature.

14 Claims, 14 Drawing Sheets

(52) U.S. Cl.
CPC ..... *G09G 2310/0202* (2013.01); *G09G 2310/0243* (2013.01); *G09G 2320/0233* (2013.01); *G09G 2320/0646* (2013.01); *G09G 2360/16* (2013.01)

(58) Field of Classification Search
USPC ..... 345/694
See application file for complete search history.

(56) References Cited

U.S. PATENT DOCUMENTS

| | | | | |
|---|---|---|---|---|
| 9,280,933 | B2 | 3/2016 | Chaji et al. | |
| 9,824,637 | B2 | 11/2017 | de Greef | |
| 10,178,329 | B2 | 1/2019 | Vogelsang et al. | |
| 10,216,971 | B2 | 2/2019 | Cho et al. | |
| 2008/0174607 | A1* | 7/2008 | Iranli | G09G 3/3406 345/589 |
| 2009/0033685 | A1* | 2/2009 | Park | G09G 3/3233 345/690 |
| 2011/0187905 | A1* | 8/2011 | Sugimoto | H04N 5/202 348/254 |
| 2017/0309213 | A1* | 10/2017 | Roh | G09G 3/2003 |
| 2018/0314380 | A1 | 11/2018 | Uehara et al. | |
| 2019/0073961 | A1 | 3/2019 | Park et al. | |
| 2019/0180694 | A1* | 6/2019 | Lim | H01L 27/3272 |

FOREIGN PATENT DOCUMENTS

| | | | |
|---|---|---|---|
| CN | 108352151 | A | 7/2018 |
| CN | 108806586 | A | 11/2018 |
| CN | 109283726 | A | 1/2019 |
| KR | 100684862 | B1 | 2/2007 |

* cited by examiner

DISPLAYS WITH LUMINANCE ADJUSTMENT CIRCUITRY TO COMPENSATE FOR GATE LINE LOADING VARIATIONS

This application claims priority to CN patent application No. 201910105225.6, filed on Feb. 1, 2019, which is hereby incorporated by reference herein in its entirety.

BACKGROUND

This relates generally to displays, and, more particularly, to displays with pixels formed from light-emitting diodes.

Electronic devices often include displays. For example, cellular telephones and portable computers include displays for presenting information to users.

Displays such as organic light-emitting diode displays have arrays of pixels based on light-emitting diodes. In this type of display, each pixel includes a light-emitting diode and thin-film transistors for controlling application of a signal to the light-emitting diode to produce light. The thin-film transistors include drive transistors. Each drive transistor is coupled in series with a respective light-emitting diode and controls current flow through that light-emitting diode.

The threshold voltages of the drive transistors in an organic light-emitting diode display may vary due to operating history effects, which can lead to brightness nonuniformity. Brightness variations may also arise from control issues in displays with non-rectangular shapes. If care is not taken, effects such as these may adversely affect display performance.

SUMMARY

A display may have an array of pixels. Display driver circuitry may supply data and control signals to the pixels. Each pixel may have switching transistors, a drive transistor, a capacitor, and a light-emitting diode such as an organic light-emitting diode or may have other thin-film transistor circuitry.

The transistors of each pixel may receive control signals using horizontal control lines, sometimes referred to as gate lines. Not all of the rows in a display may have the same number of pixels and may therefore be characterized by different amounts of gate line loading. To ensure brightness uniformity for the display, the display driver circuitry may have gate drive circuits that provide different gate line signals to different rows of pixels within the display. This allows the display driver circuitry to generate row-location-dependent gate line signals to counteract variations in display brightness from different capacitive loading effects in different rows.

In another suitable arrangement, image data may be compensated to account for gate line loading variations between rows of pixels in the display. Luminance adjustment circuitry may receive image data and generate corresponding compensated image data. The image data may be compensated based on the location of the pixel, the gray level of the image data, the display brightness, and/or temperature. A single compensation value may be used to compensate each pixel in a row of pixels, each pixel in a group of pixels, or a single pixel.

Once compensated, range adjustment circuitry may modify the compensated image data to fit a desired range. The desired range may be the range of values that the display driver circuitry of the display is configured to receive (e.g., between 0 and 255). After adjusting the range of the compensated image data to be mapped within the desired range, the image data may be dithered before ultimately being provided to the pixel array to be displayed.

DETAILED DESCRIPTION

Figure 1:
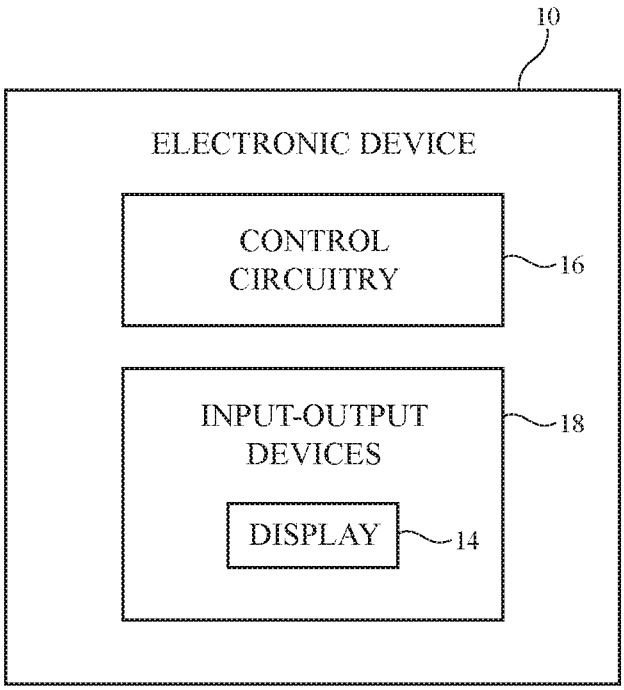
FIG. 1 is a schematic diagram of an illustrative electronic device having a display in accordance with an embodiment.

Electronic devices may be provided with displays. A schematic diagram of an illustrative electronic device with a display is shown in FIG. 1. Device 10 of FIG. 1 may be a computing device such as a laptop computer, a computer monitor containing an embedded computer, a tablet computer, a cellular telephone, a media player, or other handheld or portable electronic device, a smaller device such as a wrist-watch device (e.g., a watch with a wrist strap), a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, speakers, tone generators, vibrators, cameras, sensors (e.g., a temperature sensor that detects temperature), light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14.

Display 14 may be an organic light-emitting diode display, a display formed from an array of discrete light-emitting diodes each formed from a crystalline semiconductor die, a liquid crystal display, or any other suitable type of display. Configurations in which the pixels of display 14 include light-emitting diodes are sometimes described herein as an example. This is, however, merely illustrative. Any suitable type of display may be used for device 10, if desired.

Figure 2:
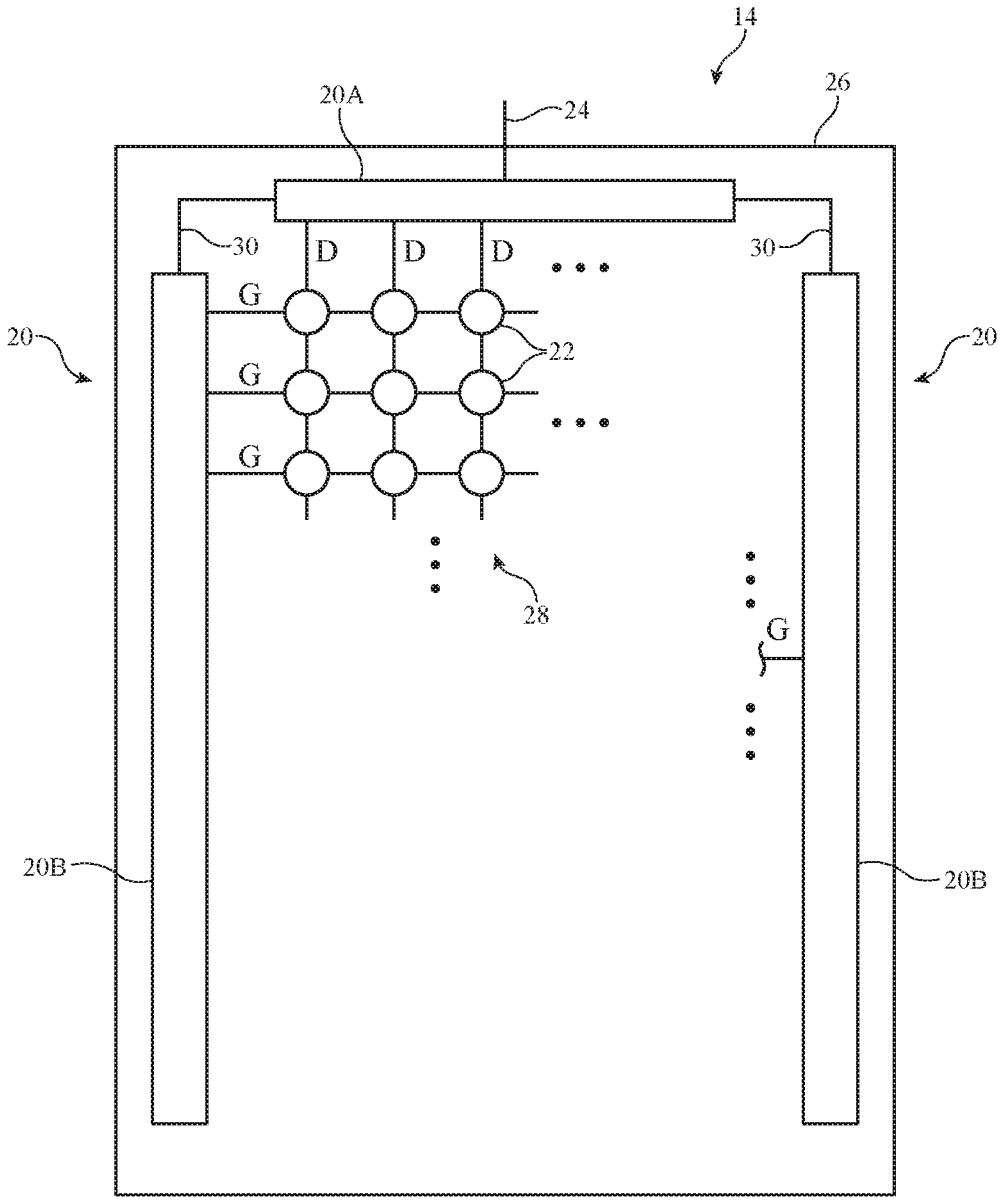
FIG. 2 is a schematic diagram of an illustrative display in accordance with an embodiment.

FIG. 2 is a diagram of an illustrative display. As shown in FIG. 2, display 14 may include layers such as substrate layer 26. Substrate layers such as layer 26 may be formed from rectangular planar layers of material or layers of material with other shapes (e.g., circular shapes or other shapes with one or more curved and/or straight edges). The substrate layers of display 14 may include glass layers, polymer layers, composite films that include polymer and inorganic materials, metallic foils, etc.

Display 14 may have an array of pixels 22 for displaying images for a user such as pixel array 28. Pixels 22 in array 28 may be arranged in rows and columns. The edges of array 28 may be straight or curved (i.e., each row of pixels 22 and/or each column of pixels 22 in array 28 may have the same length or may have a different length). There may be any suitable number of rows and columns in array 28 (e.g., ten or more, one hundred or more, or one thousand or more, etc.). Display 14 may include pixels 22 of different colors. As an example, display 14 may include red pixels, green pixels, and blue pixels. If desired, a backlight unit may provide backlight illumination for display 14.

Display driver circuitry 20 may be used to control the operation of pixels 22. Display driver circuitry 20 may be formed from integrated circuits, thin-film transistor circuits, and/or other suitable circuitry. Illustrative display driver circuitry 20 of FIG. 2 includes display driver circuitry 20A and additional display driver circuitry such as gate driver circuitry 20B. Gate driver circuitry 20B may be formed along one or more edges of display 14. For example, gate driver circuitry 20B may be arranged along the left and right sides of display 14 as shown in FIG. 2.

As shown in FIG. 2, display driver circuitry 20A (e.g., one or more display driver integrated circuits, thin-film transistor circuitry, etc.) may contain communications circuitry for communicating with system control circuitry over signal path 24. Path 24 may be formed from traces on a flexible printed circuit or other cable. The control circuitry may be located on one or more printed circuits in electronic device 10. During operation, the control circuitry (e.g., control circuitry 16 of FIG. 1) may supply circuitry such as a display driver integrated circuit in circuitry 20 with image data for images to be displayed on display 14. Display driver circuitry 20A of FIG. 2 is located at the top of display 14. This is merely illustrative. Display driver circuitry 20A may be located along the bottom edge of display 14, at both the top and bottom of display 14, or in other portions of device 10.

To display the images on pixels 22, display driver circuitry 20A may supply corresponding image data to data lines D while issuing control signals to supporting display driver circuitry such as gate driver circuitry 20B over signal paths 30. With the illustrative arrangement of FIG. 2, data lines D run vertically through display 14 and are associated with respective columns of pixels 22.

Gate driver circuitry 20B (sometimes referred to as gate line driver circuitry or horizontal control signal circuitry) may be implemented using one or more integrated circuits and/or may be implemented using thin-film transistor circuitry on substrate 26. Horizontal control lines G (sometimes referred to as gate lines, scan lines, emission control lines, etc.) run horizontally through display 14. Each gate line G is associated with a respective row of pixels 22. If desired, there may be multiple horizontal control lines such as gate lines G associated with each row of pixels (e.g., a first gate line signal GI and a second gate line signal GW, one or more emission control signals, etc.). Individually controlled and/or global signal paths in display 14 may also be used to distribute other signals (e.g., power supply signals, etc.).

Gate driver circuitry 20B may assert control signals on the gate lines G in display 14. For example, gate driver circuitry 20B may receive clock signals and other control signals from circuitry 20A on paths 30 and may, in response to the received signals, assert a gate line signal on gate lines G in sequence, starting with the gate line signal G in the first row of pixels 22 in array 28. As each gate line is asserted, data from data lines D may be loaded into a corresponding row of pixels. In this way, control circuitry such as display driver circuitry 20A and 20B may provide pixels 22 with signals that direct pixels 22 to display a desired image on display 14. Each pixel 22 may have a light-emitting diode and circuitry (e.g., thin-film circuitry on substrate 26) that responds to the control and data signals from display driver circuitry 20.

Figure 3A:
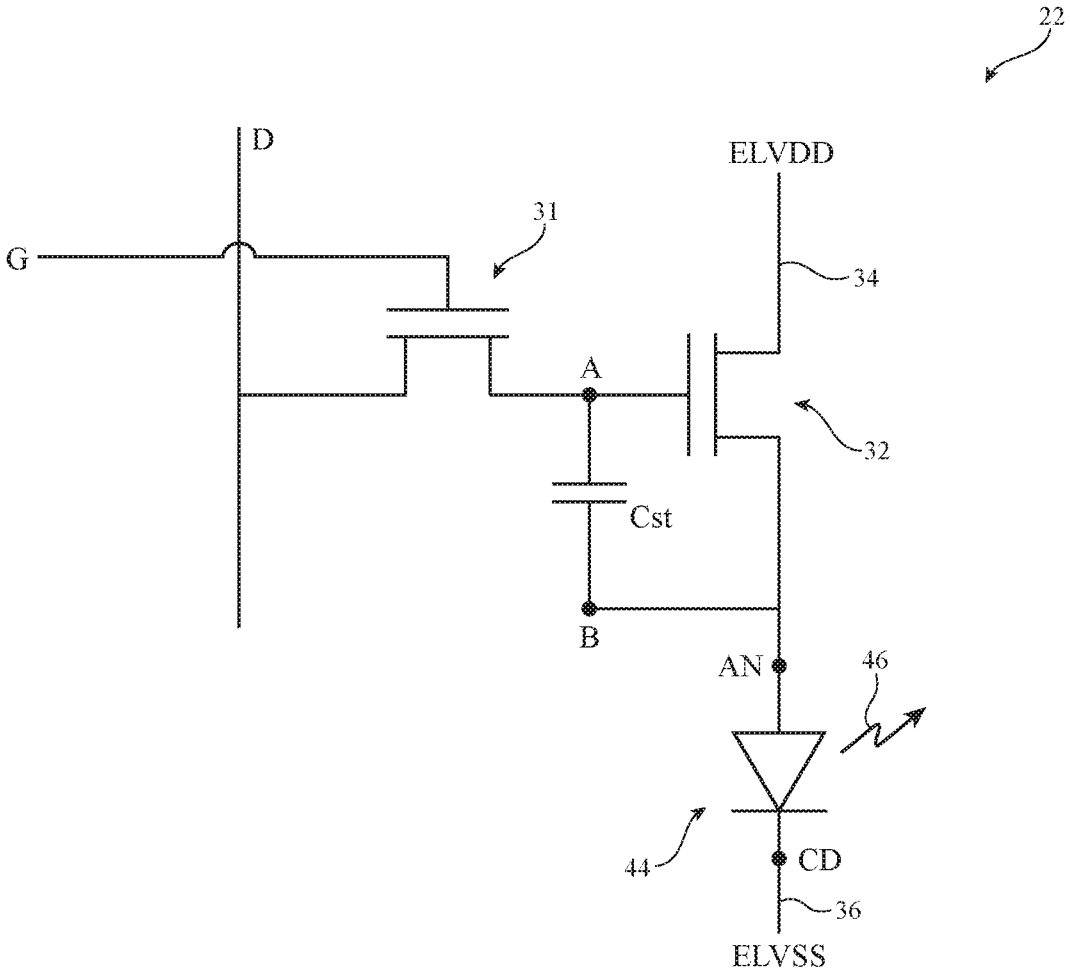
FIGS. 3A and 3B are diagrams of illustrative organic light-emitting diode pixel circuits in accordance with an embodiment.

Display 14 may be an organic light-emitting diode display. In an organic light-emitting diode display, each pixel contains a respective organic light-emitting diode. A schematic diagram of an illustrative organic light-emitting diode pixel is shown in FIG. 3A. As shown in FIG. 3A, display pixel 22 may include light-emitting diode 44. A positive power supply voltage ELVDD may be supplied to positive power supply terminal 34 and a negative power supply voltage ELVSS may be supplied to negative power supply terminal 36. Diode 44 has an anode (terminal AN) and a cathode (terminal CD). The state of drive transistor 32 controls the amount of current flowing through diode 44 and therefore the amount of emitted light 46 from display pixel 22. Cathode CD of diode 44 is coupled to negative terminal 36, so cathode terminal CD of diode 44 may sometimes be referred to as the negative terminal for diode 44.

To ensure that transistor 32 is held in a desired state between successive frames of data, display pixel 22 may include a storage capacitor such as storage capacitor Cst. A first terminal of storage capacitor Cst may be coupled to the gate of transistor 32 at node A and a second terminal of storage capacitor Cst may be coupled to anode AN of diode 44 at node B. The voltage on storage capacitor Cst is applied to the gate of transistor 32 at node A to control transistor 32. Data can be loaded into storage capacitor Cst using one or more switching transistors such as switching transistor 31. When switching transistor 31 is off, data line D is isolated from storage capacitor Cst and the gate voltage on node A is equal to the data value stored in storage capacitor Cst (i.e., the data value from the previous frame of display data being displayed on display 14). When gate line G (sometimes referred to as a scan line) in the row associated with display pixel 22 is asserted, switching transistor 31 will be turned on and a new data signal on data line D will be loaded into storage capacitor Cst. The new signal on capacitor Cst is applied to the gate of transistor 32 at node A, thereby adjusting the state of transistor 32 (sometimes referred to as drive transistor TD) and adjusting the corresponding amount of light 46 that is emitted by light-emitting diode 44.

If desired, the circuitry for controlling the operation of light-emitting diodes for pixels 22 in display 14 (e.g., transistors, capacitors, etc. in display pixel circuits such as the display pixel circuit of FIG. 3A) may be formed using configurations other than the configuration of FIG. 3A. The circuitry of pixel 22 of FIG. 3A is merely illustrative.

Figure 3B:
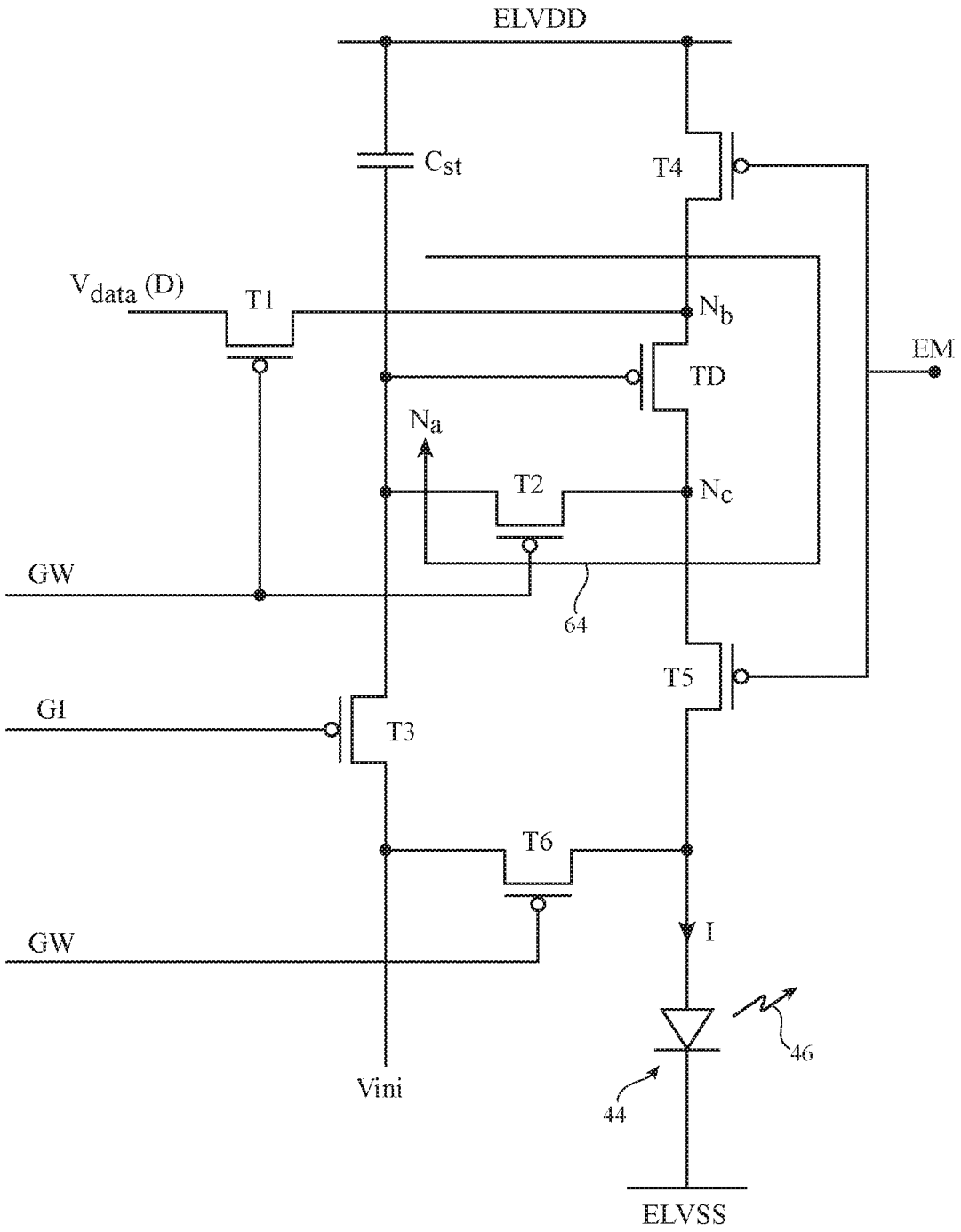

Another illustrative pixel circuit of the type that may be used for each pixel 22 in array 28 is shown in FIG. 3B. In the example of FIG. 3B, pixel circuit 22 has seven transistors T1, T2, T3, T4, T5, T6, and TD and one capacitor Cst, so pixel circuit 22 may sometimes be referred to as a 7T1C pixel circuit. Other numbers of transistors and capacitors may be used in pixels 22 if desired (e.g., fewer transistors, more transistors, more capacitors, etc.). The transistors may be p-channel transistors (e.g., p-channel metal-oxide-semiconductor transistors as shown in FIG. 3B) and/or may be n-channel transistors or other types of transistors. The active regions of thin-film transistors for pixel circuit 22 and other portions of display 14 may be formed from silicon (e.g., polysilicon channel regions), semiconducting oxides (e.g., indium gallium zinc oxide channel regions), or other suitable semiconductor thin-film layers.

As shown in FIG. 3B, pixel circuit 22 includes light-emitting diode 44 (e.g., an organic light-emitting diode, a crystalline micro-light-emitting diode die, etc.). Light-emitting diode 44 may emit light 46 in proportion to the amount of current I that is driven through light-emitting diode 44 by transistor TD. Transistor TD, transistor T4, transistor T5, and light-emitting diode 44 may be coupled in series between respective power supply terminals (see, e.g., positive power supply terminal ELVDD and ground power supply terminal ELVSS). Transistor TD may have a source terminal coupled to node Nb, a drain terminal coupled to transistor T5, and a gate terminal coupled to node Na. The voltage on node Na at the gate of transistor TD controls the amount of current I that is produced by transistor TD. This current is driven through light-emitting diode 44, so transistor TD may sometimes be referred to as a drive transistor.

Transistors T4 and T5 can be turned off to interrupt current flow between transistor TD and diode 44 and transistors T4 and T5 may be turned on to enable current flow between transistor TD and diode 44. Emission enable control signal EM may be applied to the gates of transistors T4 and T5 from a shared gate line. During operation, transistors T4 and T5 are controlled by emission enable control signal EM and are therefore sometimes referred to as emission transistors or emission enable transistors. Control signals GW and GI which may sometimes be referred to as switching transistor control signals, scan signals, or gate line signals (e.g., gate initialization and gate write signals, gate signals, etc.), are applied to the gates of switching transistors T1, T2, T3, and T6 and control the operation of transistors T1, T2, T3, and T6.

Control signals EM, GI, and GW may be controlled by display driver circuitry 20 to place pixels 22 of display 14 in different states during the operation of display 14. During these different states, image data is loaded into pixels 22 and pixels 22 use light-emitting diodes 44 to emit light 46 in proportion to the loaded pixel data. To minimize threshold voltage variations due to differences in transistor history (e.g., historical Vgs values), each of the pixels can be conditioned by deliberately applying a known voltage stress to drive transistors TD (sometimes referred to as on-bias stress).

Figure 4:
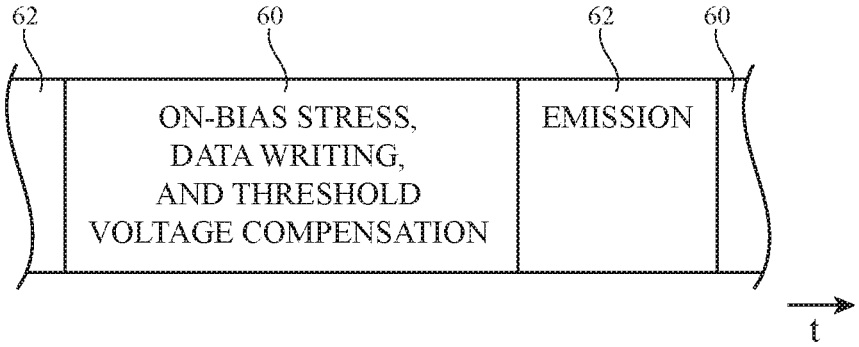
FIG. 4 is a timing diagram showing operations involved in using a pixel circuit of the type shown in FIG. 3B in a display in accordance with an embodiment.

As an example, display driver circuitry 20 may use control signals EM, GI, and GW to place pixels 22 in a first mode of operation (see, e.g., phase 60 of FIG. 4) before using pixels to emit light (in a second mode of operation such as phase 62 of FIG. 4). During operation, phases 60 and 62 can repeatedly alternate.

During phase 60, which may sometimes be referred to as a preconditioning phase or an on-bias stress, data writing, and threshold voltage compensation phase, on-bias stress may be applied to the drive transistor TD of each pixel 22 and data (D) from the data line may be loaded onto capacitor Cst (node Na) of that pixel 22. During phase 62, which may sometimes be referred to as an emission phase, drive transistor TD of each pixel 22 supplies drive current I to light-emitting diode 44 of that pixel, so that light-emitting diode 44 emits light 46. During phase 60, the data loaded onto capacitor Cst may be shifted from Vdata (the voltage on data line D) by an amount equal to the threshold voltage Vt of drive transistor TD, so that the drive current I of transistor TD is independent of Vt during emission phase 62 (i.e., the pixel circuit of FIG. 3B may be used to implement an internal threshold voltage compensation scheme). Other data writing schemes (e.g., in which the drive current I is dependent upon threshold voltage Vt) may be used if desired.

In configurations for device 10 in which display 14 has the same number of pixels 22 in each row of display 14, the capacitive loading on the gate lines of display 14 will be relatively even across all of the rows of display 14. In other configurations for display 14 such as the illustrative configuration of FIG. 5, different rows of display 14 may contain different numbers of pixels 22. This may give rise to a row-dependent capacitive loading on the gate lines (e.g., the gate lines carrying signals such as signals GI and GW) that can affect the preconditioning operations and the data loaded onto node Na and therefore the resulting brightness of light 46 in the pixels 22 of each row.

Figure 5:
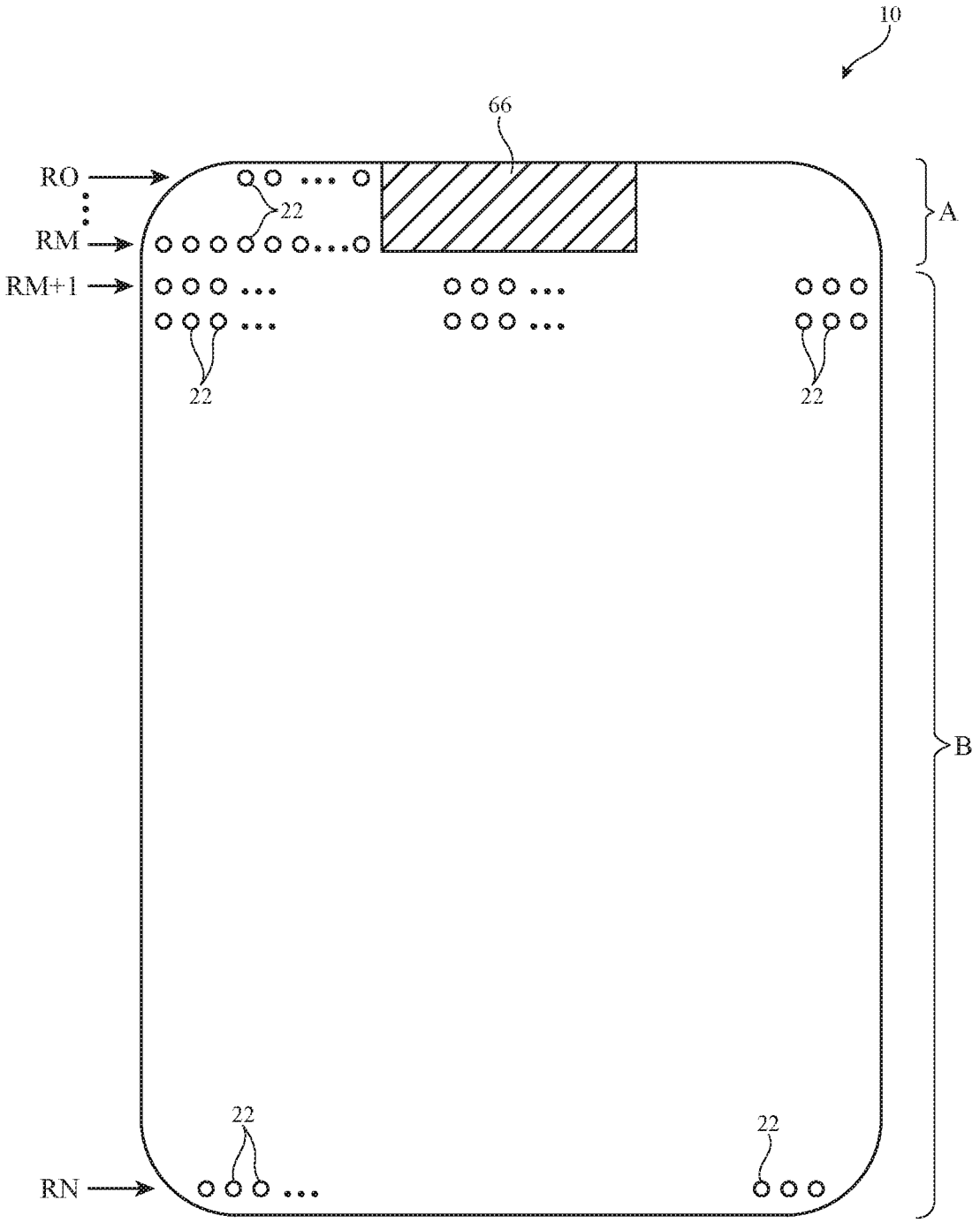
FIG. 5 is a diagram of an illustrative display that has a pixel-free notch along its upper edge and that therefore has different capacitive loading in different rows of the display in accordance with an embodiment.

In the illustrative arrangement of FIG. 5, display 14 has a rectangular shape with four curved corners and a recess (i.e., pixel-free notched region 66). The notch interrupts the rows of pixels 22 and creates short rows having fewer pixels than the normal-length rows that span the width of the substrate of display 14. Due to the curved corners of display 14, each row in the top and bottom edge of display 14 will have a slightly different amount of capacitive loading. Due to the gradually curved shape of the peripheral edge of display 14 at the top and bottom edges of display 14, the row-to-row change in the number of pixels 22 that load the gate lines will be gradual in these regions. As a result, luminance variations due to changes in row length (and therefore pixel count) between adjacent rows may be minimal and not noticeable to a viewer of display 14.

More abrupt shape changes such as the changes in display 14 due to notch 66 may introduce more significant changes in pixel loading on the gate lines. Rows such as row RM+1 . . . RN in display 14 of FIG. 5 have pixel counts that are equal (or, in the case of the rows at near the bottom edge of display 14, are nearly equal) to each other. On the other hand, rows such as rows R0 . . . RM will have pixel counts that are less than half of the pixel counts of rows RM+1 . . . RN. This is because each gate line in rows R0 . . . RM will only extend to the left or right boundary of region 66 and will not be able to traverse region 66.

Because the gate lines in area A of display 14 (i.e., the gate lines of rows R0 . . . RM in the top edge of display 14 adjacent to region 66) and the gate lines in area B of display 14 (i.e., the gate lines of rows RM+1 . . . RN) experience different amounts of loading in the example of FIG. 5, there is a risk that pixels 22 in areas A and B will be loaded with different voltages on their storage capacitors Cst, even in the presence of identical Vdata values on their data lines. Electronic device 10 may therefore compensate the pixels in rows R0 . . . RM to ensure uniform luminance between all of the rows in the display. To compensate for these row-dependent gate line loading effects, display driver circuitry 20 can create gate line signals G that vary as a function of row. For example, display driver circuitry 20 can produce gate line signals for the rows in area A that have shorter pulse widths than the gate lines signals for the rows in area B. The gate line signals with shorter pulse widths that are used in area A will then load the pixels in area A in the same way that the gate line signals with longer pulse widths that are used in area B will load the pixels in area B.

Figure 6:
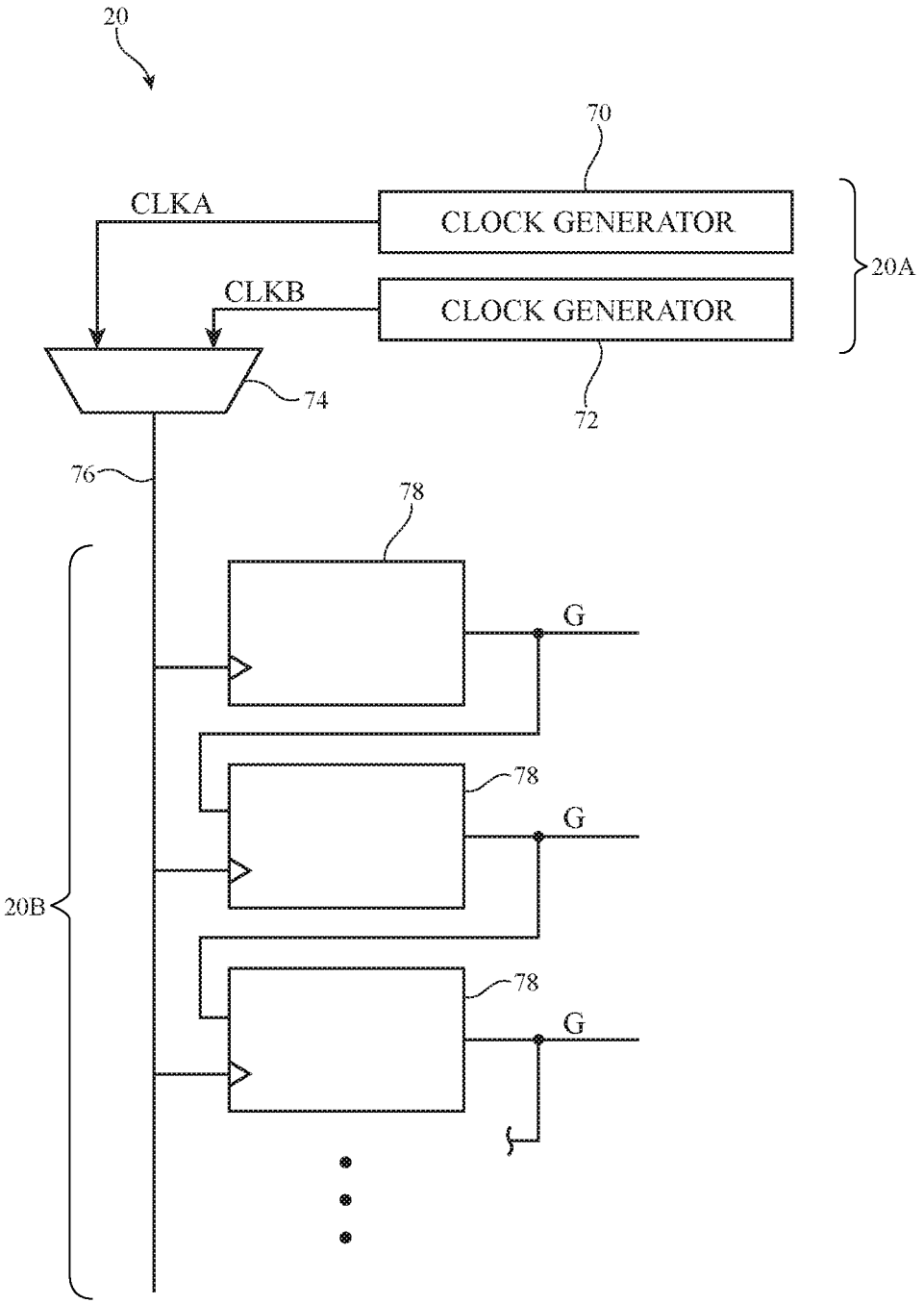
FIG. 6 is a diagram of display driver circuitry of the type that may be used to provide different rows of pixels with different gate line signals to account for different capacitive loading effects in different rows in accordance with an embodiment.

Illustrative display driver circuitry for providing the rows of pixels 22 in area A with different gate signals than the rows of pixels 22 in area B is shown in FIG. 6. As shown in FIG. 6, display driver circuitry 20A (e.g., an integrated circuit, thin-film transistor circuitry, etc.) may include clock generators such as clock generators 70 and 72 that produce different clock signals (e.g., clock signals that different in pulse width, pulse slew rate, and/or other attributes). These signals may be provided to the clock inputs of gate driver circuits 78 of gate driver circuitry 20B via multiplexer 74 and clock distribution path 76. The output G of each gate driver circuit 78 may be provided to a subsequent gate driver circuit 78 to form a shift register. In the example of FIG. 6, each gate driver circuit produces a gate signal for a respective row of pixels 22. If desired, circuitry 20B may produce multiple gate line output signals (e.g., signals GI and GW) for each row. The shift register formed from circuits 78 allows a gate line signal (or gate line signals when each circuit 78 has multiple outputs corresponding to multiple gate lines in each row) to be asserted in each row of display 14 in sequence.

The clock signals from line 76 are distributed to the clock inputs of each gate driver circuit 78, which then use these clocks in producing corresponding output signals G. The shape of the clock signal on line 76 when a given gate line signal is being produced can be used to control the shape of the given gate line signal. In particular, clock signal attributes (e.g., pulse width) for the clock signals on line 76 affect gate line signal attributes (e.g., pulse width), so changes to clock signals on path 76 can be used in controlling gate line signals G.

When it is desired to supply a first type of clock signal to gate driver circuits 78 of gate driver circuitry 20B (e.g., when producing gate line signals for the pixels in area A), display driver circuitry 20A may configure multiplexer 74 so that output CLKA of clock generator 70 is routed to gate driver circuits 78 in circuitry 20A via path 76. When it is desired to supply a second type of clock signal to gate driver circuits 78 of gate driver circuitry 20B (e.g., when producing gate line signals for the pixels in area B), display driver circuitry 20A may configure multiplexer 74 so that output CLKB of clock generator 72 is routed to gate driver circuits 78 in circuitry 20A via path 76. During each frame of image data, multiplexer 74 may be placed in its first state (coupling clock generator 70 to path 76) during the rows of area A and may be placed in its second state (coupling clock generator 72 to path 76) during the rows of area B. If desired, a path may provide signals from clock generator 70 directly to the rows of area A and an additional path may provide signals from clock generator 72 directly to the rows of area B (and multiplexer 74 may optionally be omitted).

Figure 7:
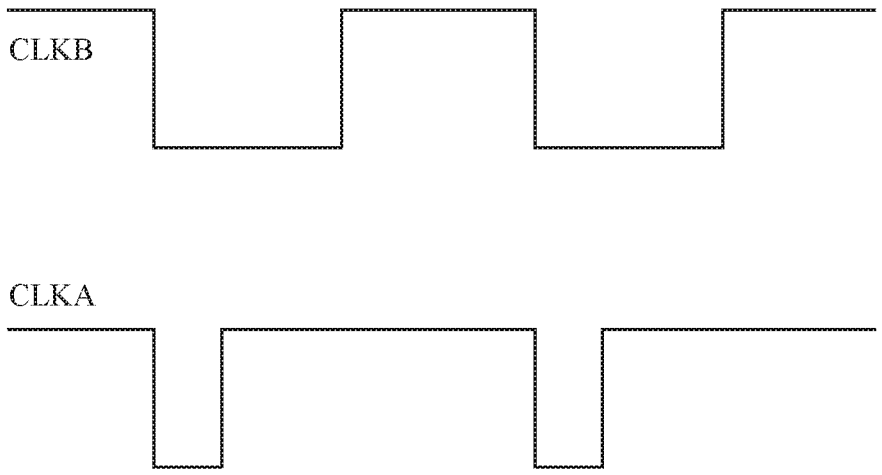
FIG. 7 is a timing diagram of different gate line signals that may be provided to different rows of pixels in accordance with an embodiment.

FIG. 7 shows illustrative signals CLKB and CLKA of the type that may be provided to respective areas B and A to reduce luminance variations between areas B and A. In FIG. 7, the pulse width (pulse duration) of signal CLKA is smaller than the pulse width (pulse duration) of signal CLKB. The longer pulse width of CLKB, which is used in region B, helps compensate for the additional loading on the gate lines in the rows of pixels in region B. Other variations to signals CLKB and CLKA may be made to compensate for the additional loading on pixels in area B compared to pixels in area A (e.g., the signals may have different slew rates, may have different shaped profiles such as a two-step profile versus a one-step profile, etc.).

Additional compensation schemes may be used to mitigate brightness variations between rows of different lengths caused by gate line loading variations. For example, physical structures such as dummy pixels (e.g., structures similar to pixels 22 with one or more missing components that prevent the dummy pixels from emitting light) or capacitors may be coupled to the shorter rows in area A. Adding supplemental gate line loading structures in this way may even out the gate line loading between pixels in area A and pixels in area B. However, the supplemental gate line loading structures may occupy valuable area within the electronic device. Therefore, another compensation scheme may include compensating image data to be displayed in area A to account for any brightness variations caused by differences in gate line loading.

Figure 8:
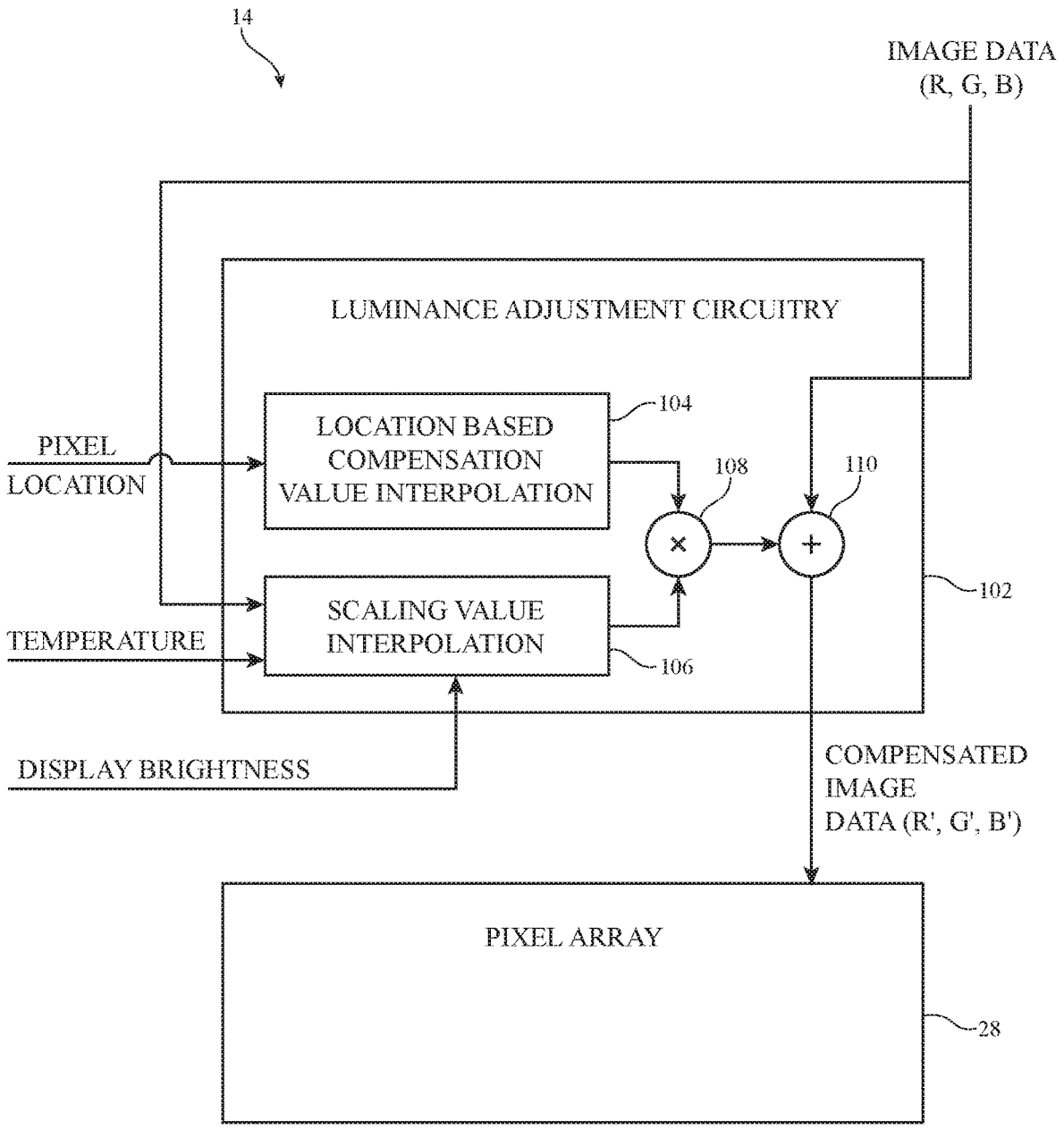
FIG. 8 is a schematic diagram of an illustrative display with luminance adjustment circuitry for compensating image data to account for different capacitive loading effects in different rows in accordance with an embodiment.

FIG. 8 is a schematic diagram of an illustrative display that includes luminance adjustment circuitry that compensates image data to account for gate line loading variations within the display. As shown in FIG. 8, luminance adjustment circuitry 102 (sometimes referred to as luminance compensation circuitry) may receive image data (e.g., red (R), blue (B), and green (G) values between 0 and 255) and output corresponding compensated image data (e.g., a red compensated value (R'), green compensated value (G'), and blue compensated value (B')).

To generate the compensated image data, compensation value block 104 (sometimes referred to as location based compensation value block 104, location based compensation value circuitry 104, compensation value generating circuitry 104, block 104, circuitry 104, etc.) may generate a location based compensation value. The location based compensation value may be a compensation value (e.g., one for each color pixel) that is used to adjust the received image data. The compensation value ($V_{COMP}$) may be based on the location of the pixel that is being compensated. Based on the location, location based compensation value block 104 generates a corresponding compensation value. If desired, location based compensation value block 104 may use interpolation to determine the compensation value. For example, compensation values may only be known for some of the pixels (e.g., compensation values may be stored in a lookup table). Interpolation may be used to determine compensation values for pixels between the known pixels.

Location may not be the only factor used to compensate the image data for gate line loading variations. Other factors such as the display brightness, temperature, and the image data for the pixel (e.g., the gray level of the pixel) may be accounted for when compensating the image data. In particular, scaling value block 106 (sometimes referred to as scaling value circuitry 106, scaling value generating circuitry 106, scaling value interpolation block 106, scaling value interpolation circuitry 106, block 106, circuitry 106, etc.) may receive information such as the image data (R, G, B) for the particular pixel (which may be used to determine the gray level for the particular pixel), the temperature of the display (e.g., temperature data from a temperature sensor within the electronic device), and the display brightness (e.g., the brightness in nits). Scaling value interpolation block 106 may output a respective scaling value ($V_{SCALE}$) based on the received information. The scaling value interpolation block may use lookup tables and/or interpolation to determine a respective scaling value for each pixel.

Each color may have a respective compensation value if desired. For example, block 104 may generate a red pixel compensation value $V_{COMP_R}$, a green pixel compensation value $V_{COMP_G}$, and a blue pixel compensation value $V_{COMP_B}$ based on the received pixel location. Each color may also have a respective scaling value (sometimes referred to as scaling factor) if desired. Block 106 may generate a red pixel scale value $V_{SCALE_R}$, a green pixel scale value $V_{SCALE_G}$, and a blue pixel scale value $V_{SCALE_B}$ based on the received image data, temperature, and display brightness. This example is merely illustrative, and the same compensation factor may optionally be applied to the red, green, and blue image data.

Multiplication circuit 108 may scale the compensation value from block 104 by multiplying the compensation value by the scaling value from block 106 (e.g., $V_{COMP} \times V_{SCALE}$). This value (sometimes referred to as a scaled compensation value) may then be provided from multiplication circuit 108 to addition circuit 110. Addition circuit 110 may add the scaled compensation value to the image data to obtain compensated image data R', G', and B' (e.g., $R'=R+V_{COMP,R} \times V_{SCALE,R}$, $G'=G+V_{COMP,G} \times V_{SCALE,G}$, and $B'=B+V_{COMP,B} \times V_{SCALE,B}$).

The compensated image data is then provided to pixel array 28 to be displayed.

Because the compensated image data is the same format as the original image data (e.g., red, blue and green values between 0 and 255), no modification is required for pixel array 28 to display the compensated image data.

As previously discussed, location based compensation value block 104 may generate a compensation value based on pixel location. In some situations, only a pixel's row may be accounted for when determining the compensation value. For example, consider the display of FIG. 5. Every pixel in the first row (R0) of the display may have the same compensation value (even though the pixels are positioned in different columns of the display). Producing a compensation value based solely on the pixel's row (and not the pixel's column) may be referred to as one-dimensional compensation (as only one dimension is taken into account when assigning the compensation value).

The example of block 104 using one-dimensional compensation is merely illustrative. Block 104 may instead factor in both the pixel's row and column when determining the compensation value. This type of compensation may be referred to as two-dimensional compensation. In one example of two-dimensional compensation, each pixel may have a respective compensation value. However, this may have a corresponding high memory requirement. Therefore, the pixels may be organized in groups of more than one pixel, with every pixel in a given group having the same compensation value. Each group may, for example, include sixteen pixels arranged in a 4×4 grid. Alternatively, each group may include four pixels in a 1×4 arrangement. The example of each pixel having a respective compensation value may be described as each pixel forming a 1×1 group. Groups of any other desired size may be used. To summarize, location based compensation value interpolation block 104 may have compensation values stored (e.g., in a lookup table). The number of pixels that share a common compensation value may be selected based on the particular design of the display. For example, each row of pixels may share a common compensation value (e.g., 1-dimensional compensation), each pixel may have a respective compensation value (e.g., 2-dimensional compensation with 1×1 groups), or groups of pixels may have a respective compensation value (e.g., 2-dimensional compensation with 4×4 or other sized groups).

If desired, different portions of the display may have different compensation schemes. For example, a first portion of the display may have 1-dimensional compensation whereas a second portion of the display may have 2-dimensional compensation. In another example, a first portion of the display may have 2-dimensional compensation with pixel groups of a first size and a second portion of the display may have 2-dimensional compensation with pixel groups of a second size. Using different types of compensation schemes in the display may be referred to as adaptive compensation. Adaptive compensation may help balance compensation accuracy (which increases as the size of pixel groups having the same compensation value decreases) with memory requirements (which increase as the size of pixel groups having the same compensation value decreases).

Figure 9:
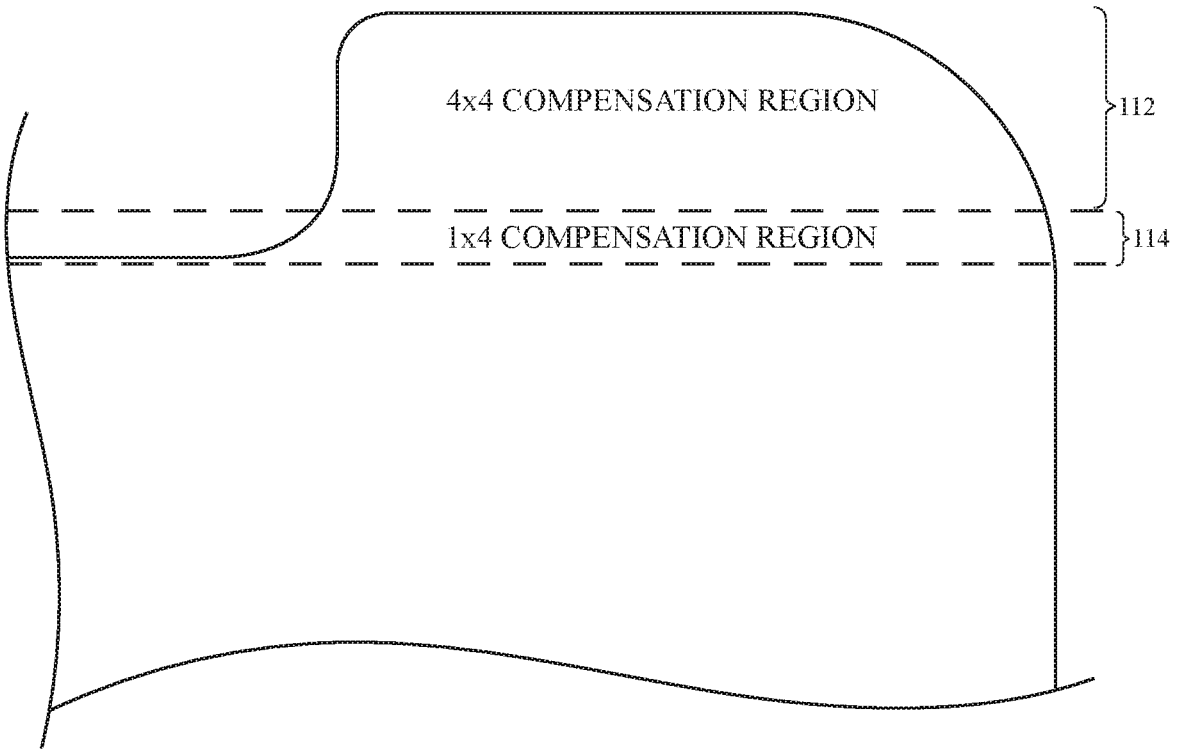
FIG. 9 is a diagram of an illustrative display with adaptive compensation for gate line loading variations in accordance with an embodiment.

FIG. 9 is an example of a display with adaptive compensation for gate line loading variations. As shown in FIG. 9, a first portion 112 of the display may have one compensation value for each 4×4 group of pixels. In contrast, a second portion 114 of the display may have one compensation value for each 1×4 group of pixels. Region 114 of the display may be susceptible to luminance variations if 4×4 groups of pixels are used to assign compensation values. Therefore, to improve the compensation accuracy, a smaller group of pixels (e.g., 1×4 groups as in FIG. 9, 1×1 groups, or groups of any other desired size) may be used in region 114. In region 112, however, having a compensation value for each 4×4 groups of pixels may result in satisfactory compensation (e.g., uniform luminance across the display). Therefore, to reduce memory requirements, the 4×4 groups of pixels may be used in region 112 instead of smaller groups such as 1×4 groups or 1×1 groups.

Figure 10:
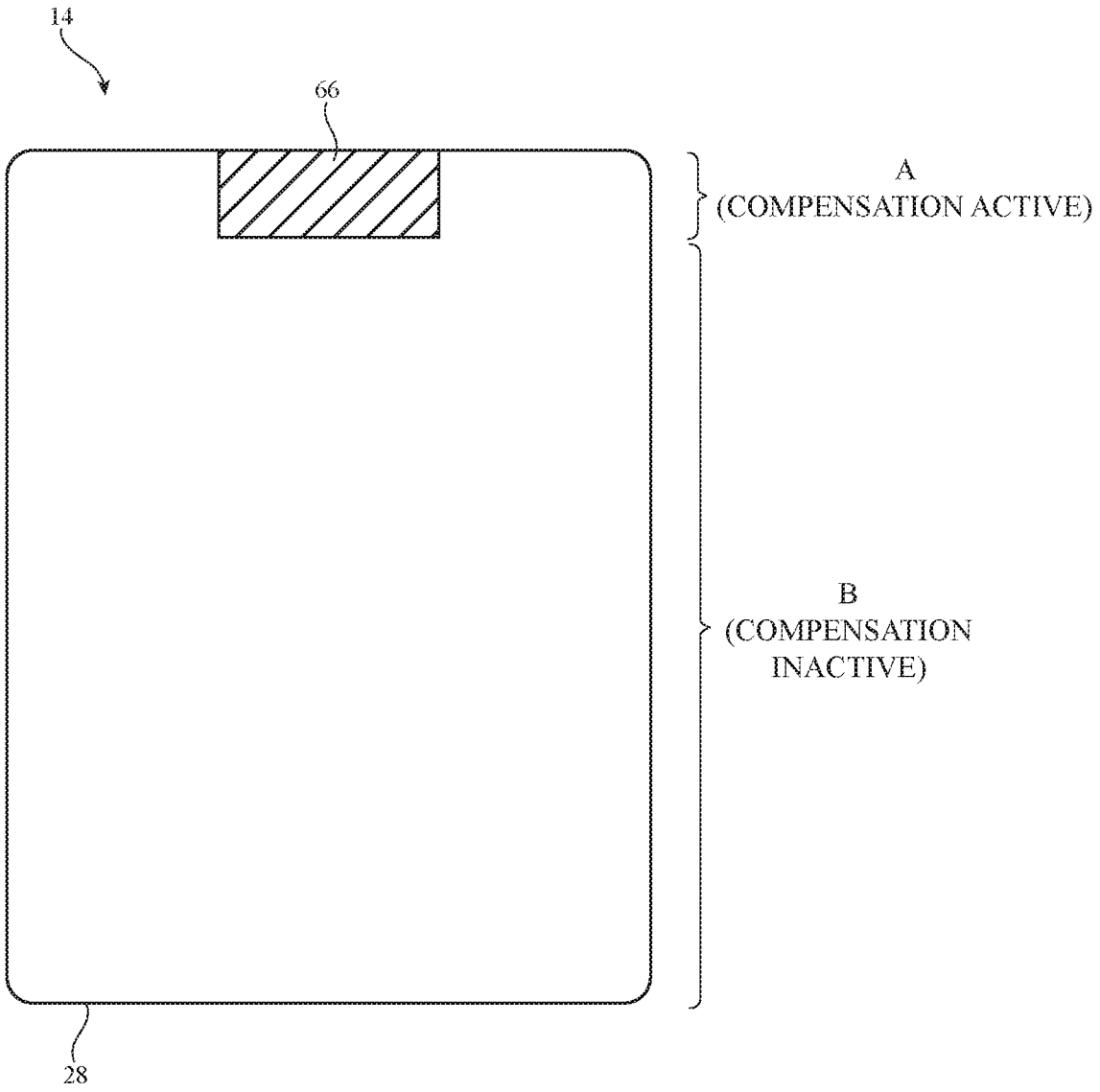
FIG. 10 is a diagram of an illustrative display that has a first portion along its upper edge with a pixel-free notch in which rows are compensated and a second portion in which rows are not compensated in accordance with an embodiment.

In rows of display 14 that extend completely across the display (e.g., rows that are uninterrupted by a notch or hole in the display), compensation for gate line loading variations may not be required. Therefore, the luminance adjustment circuitry may be inactive and not compensate image data in those rows. This concept is illustrated in the top view of FIG. 10. As shown in FIG. 10, area A of the display (which includes notch 66) has rows that are shorter than the remaining rows in the display. Gate line compensation is therefore required for these rows, so compensation is active for the rows in area A of the display. In contrast, area B of the display has pixel rows that are uninterrupted by the notch and extend from edge to edge of the display. Compensation is therefore inactive for the pixel rows in area B of the display.

Figure 11:
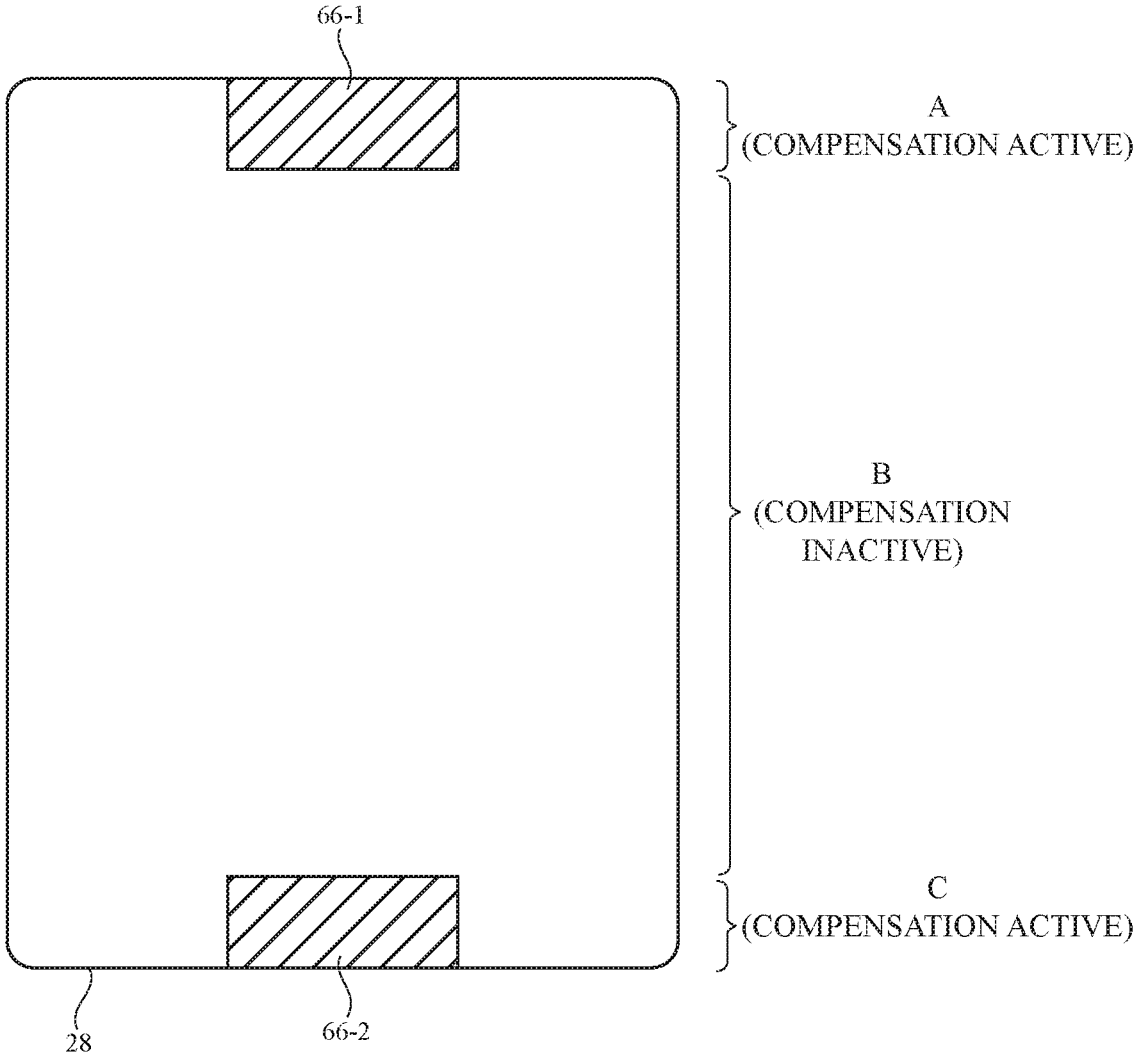
FIG. 11 is a diagram of an illustrative display that has first and second portions in which rows are compensated and a third portion in which rows are not compensated in accordance with an embodiment.

These principles may be applied to displays having any desired shape. For example, a display may have multiple regions with short rows that require compensation (due to the presence of one or more notches, one or more holes, etc.). An example of a display of this type is shown in FIG. 11. As shown in FIG. 11, area A of the display (which includes a first notch 66-1) has rows that are shorter than the remaining rows in the display. Gate line compensation is therefore required for these rows, so compensation is active for the rows in area A of the display. In contrast, area B of the display has pixel rows that are uninterrupted by the notch and extend from edge to edge of the display. Compensation is therefore inactive for the pixel rows in area B of the display. Area C of the display (which includes a second notch 66-2) has rows that are shorter than the remaining rows in the display. Gate line compensation is therefore required for these rows, so compensation is active for the rows in area C of the display.

In general, any rows of a display with substantially fewer pixels (e.g., less than 3% the number of pixels, less than 5% the number of pixels, less than 10% the number of pixels, less than 20% the number of pixels, less than 40% the number of pixels, etc.) than the full width rows may be compensated. Compensation may be inactive for the remaining rows in the display. Each region for which may compensation is inactive may be interposed between two respective regions for which compensation is active. Each region for which may compensation is active may be interposed between two respective regions for which compensation is inactive. Active compensation regions may be a result of a notch in the display, a hole in the display (e.g., a hole in the active area of the display that is completely laterally surrounded by pixels), a rounded corner of the display, etc. Any desired number of discrete active compensation regions (each including any desired number of pixel rows) may be included in the display.

Once compensated, the image data may be provided to the pixel array so that the image corresponding to the image data is displayed on the pixel array. In particular, the image data may be provided to display driver circuitry such as display driver circuitry 20A in FIG. 2. The display driver circuitry may be configured to receive values between 0 and 255 for each colored pixel in the display. When the image data is compensated for gate line loading variations, additional steps may be taken to ensure the compensated image data is within this range.

Figure 12:
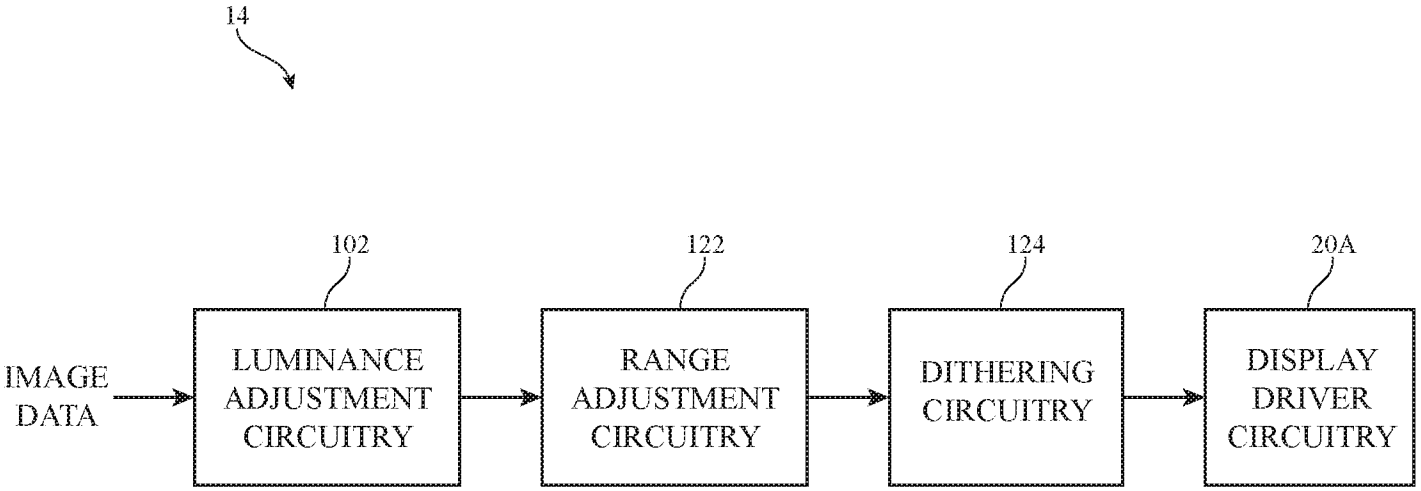
FIG. 12 is a schematic diagram of an illustrative display showing how compensation circuitry may include range adjustment circuitry and dithering circuitry in accordance with an embodiment.

FIG. 12 is a schematic diagram of an illustrative display with range adjustment circuitry to ensure that values between 0 and 255 are provided to the display driver circuitry. As shown in FIG. 12, image data may be provided to luminance adjustment circuitry 102. The image data may initially have a brightness value between 0 and 255 for each pixel. Luminance adjustment circuitry 102 may compensate the image data for gate line loading variations, as discussed in connection with FIG. 8. However, the compensation performed by luminance adjustment circuitry 102 may result in compensated image data that includes image data outside of the desired 0-255 range.

As one illustrative example, consider a set of image data that initially includes a value of 255 for a given pixel. The luminance adjustment circuitry 102 may compensate the value for gate line loading variations and produce a compensated value of 275. However, this value is too high to provide to the display driver circuitry. Accordingly, range adjustment circuitry 122 may adjust the compensated image data 102 to ensure the image data is distributed across a 0-255 range. The compensated image data from luminance adjustment circuitry 102 may have a minimum value (that may be less than 0) and a maximum value (that may be greater than 255). Range adjustment circuitry 122 may take the difference between the minimum value and the maximum value and evenly divide this range between 0 and 255 (or another range that the display driver circuitry is configured to receive). Once adjusted, the minimum value from the compensated data maps to 0 and the maximum value of the compensated data maps to 255.

After range adjustment circuitry 122 adjusts the compensated image data from luminance adjustment circuitry 102 to fall within the desired range (e.g., 0-255), the image data may be provided to dithering circuitry 124. Dithering circuitry 124 may dither the received image data to avoid patterned errors caused by compressing the data into the desired range. In particular, dithering may improve display performance at low gray levels. Any desired dithering scheme may be used to dither the image data. The dithering schemes may include randomly or pseudo-randomly adding one or more adjustment factors (e.g., +1 or −1) to the image data. After dithering circuitry 124 dithers the image data, the compensated image data may be provided to display driver circuitry 20A to be displayed on the pixel array.

The circuitry depicted in FIG. 12 may be formed at any desired location within the electronic device. The electronic device may include a graphics processing unit (GPU) that is used to generate the image data. The GPU may optionally be integrated with a system on chip (SoC). The electronic device may include a display driver integrated circuit that receives image data from system control circuitry such as the GPU. The circuitry for compensating image data to account for gate line loading variations may be incorporated in the GPU, elsewhere in the SoC, in the display driver integrated circuit, or at any other desired location within the electronic device. Luminance adjustment circuitry 102, range adjustment circuitry 122, and dithering circuitry 124 may collectively be referred to as gate line loading variation compensation circuitry (or simply compensation circuitry). The compensation circuitry may be incorporated into the electronic device in any location that allows the compensation circuitry to compensate the image data before the image data is displayed by the pixels.

Figure 13:
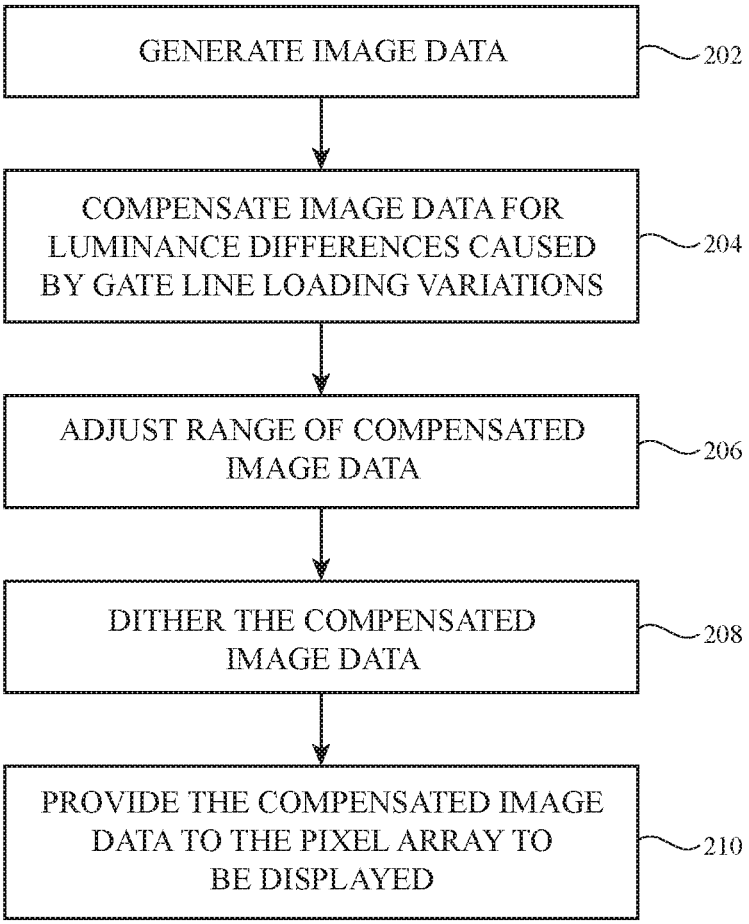
FIG. 13 is a flowchart of illustrative method steps for operating a display with luminance adjustment circuitry for compensating image data to account for different capacitive loading effects in different rows in accordance with an embodiment.

FIG. 13 is a flowchart of method steps for operating a display that includes compensation circuitry (e.g., the display of FIG. 12). As shown, at step 202 image data may be generated (e.g., by a graphics processing unit or other component within the display). At step 204, the image data may be compensated to account for luminance differences caused by gate line loading variations between rows of the display. In particular, luminance adjustment circuitry such as luminance adjustment circuitry 102 in FIG. 8 may receive the image data and output compensated image data. The image data may be compensated based on the location of the pixel within the pixel array, the gray level of the image data, the temperature, and the brightness of the display. A compensation value may be determined based on the location of the pixel. A scaling factor based on the gray level, the temperature, and/or the brightness of the display may then be used to scale the compensation value. The scaled compensation value is then added to the image data to compensate the image data. Pixels outside of the active compensation area (e.g., pixels in rows that extend entirely across the pixel array) may not be compensated.

Next, at step 206, the range of the compensated image data may be adjusted. In particular, range adjustment circuitry such as range adjustment circuitry 122 in FIG. 12 may modify the compensated image data to fit a desired range. The desired range may be the range of values that the display driver circuitry of the display is configured to receive, for example. The range may be between 0 and 255 in one illustrative example.

After adjusting the range of the compensated image data to be mapped within the desired range (e.g., between 0 and 255), the image data may be dithered at step 208. Dithering the image data may include randomly applying an adjustment factor to each value. Dithering the image data may result in better display performance at low gray values. Finally, at step 210, the dithered image data may be provided to the pixel array (e.g., to display driver circuitry such as display driver circuitry 20A) to be displayed.

The foregoing is merely illustrative and various modifications can be made by those skilled in the art without departing from the scope and spirit of the described embodiments. The foregoing embodiments may be implemented individually or in any combination.

What is claimed is:

1. A display, comprising:
display driver circuitry;
data lines coupled to the display driver circuitry;
gate lines coupled to the display driver circuitry;
an array of pixels having columns and rows,
wherein the rows in a first area of the display are shorter than the rows in a second area of the display; and
luminance adjustment circuitry configured to receive image data and output corresponding compensated image data to the display driver circuitry, wherein the compensated image data is compensated to account for differences in gate line loading between the gate lines in the first and second areas, wherein the luminance adjustment circuitry is configured to compensate the image data for each pixel based on a respective pixel group in which that pixel is located and wherein each pixel group includes at least two pixels and less than an entire row of pixels.

2. The display defined in claim 1, wherein the luminance adjustment circuitry is configured to compensate image data for a given pixel based on a location of the given pixel.

3. The display defined in claim 2, wherein the luminance adjustment circuitry is configured to compensate the image data for the given pixel based on a brightness of the display.

4. The display defined in claim 3, wherein the luminance adjustment circuitry is configured to compensate the image data for the given pixel based on a gray level of the given pixel.

5. The display defined in claim 4, wherein the luminance adjustment circuitry is configured to compensate the image data for the given pixel based on a temperature.

6. The display defined in claim 1, wherein the luminance adjustment circuitry is configured to generate a compensation value for a given pixel based on a location of the given pixel.

7. The display defined in claim 6, wherein the luminance adjustment circuitry is configured to generate a scaling factor for the given pixel based at least on a gray level of the given pixel and a display brightness level.

8. The display defined in claim 1, further comprising:
range adjustment circuitry configured to modify the compensated image data to fit a given range of values.

9. The display defined in claim 8, further comprising:
dithering circuitry configured to dither the compensated image data.

10. The display defined in claim 1, wherein the luminance adjustment circuitry is configured to compensate image data for a given pixel based on a row in which the given pixel is positioned.

11. A display, comprising:
display driver circuitry;
data lines coupled to the display driver circuitry;
gate lines coupled to the display driver circuitry;
an array of pixels having columns and rows, wherein the rows in a first area of the display are shorter than the rows in a second area of the display; and
luminance adjustment circuitry configured to receive image data and output corresponding compensated image data to the display driver circuitry, wherein the compensated image data is compensated to account for differences in gate line loading between the gate lines in the first and second areas, wherein the luminance adjustment circuitry is configured to generate a compensation value for a given pixel based on a location of the given pixel, wherein the luminance adjustment circuitry is configured to generate a scaling factor for the given pixel based at least on a gray level of the given pixel and a display brightness level, and wherein the luminance adjustment circuitry includes a multiplication circuit that is configured to multiply the compensation value by the scaling factor to produce a scaled compensation value and an addition circuit that adds the scaled compensation value to the image data for the given pixel.

12. The display defined in claim 11, wherein the luminance adjustment circuitry is configured to generate the scaling factor for the given pixel based on the gray level of the given pixel, the display brightness level, and a temperature.

13. A display, comprising:
a substrate with a notch, wherein the notch has first and second opposing sides;

organic light-emitting diode pixels on the substrate, wherein some of the organic light-emitting diode pixels are positioned on the first side of the notch and some of the organic light-emitting diode pixels are positioned on the second side of the notch;

display driver circuitry;

data lines coupled to the display driver circuitry and the organic light-emitting diode pixels;

gate lines coupled to the display driver circuitry and the organic light-emitting diode pixels, wherein the organic light-emitting diode pixels are arranged in columns and rows, wherein the rows in a first area of the display that includes the notch are coupled to fewer of the organic light-emitting diode pixels than the rows in a second area of the display; and compensation circuitry configured to receive image data, compensate the image data for pixels in the rows in the first area, and provide the compensated image data to the display driver circuitry, wherein the compensation circuitry is configured to compensate the image data for each pixel in the rows in the first area based on a location of that pixel and wherein the compensation circuitry is configured to not compensate the image data for each pixel in the rows in the second area of the display.

14. The display defined in claim 13, wherein the substrate has first and second opposing, parallel edges connected by third and fourth opposing, parallel edges, wherein the notch is formed in the first edge of the substrate, wherein the organic light-emitting diode pixels positioned on the first side of the notch are positioned between the third edge of the substrate and the first side of the notch, wherein the organic light-emitting diode pixels positioned on the second side of the notch are positioned between the fourth edge of the substrate and the second side of the notch, wherein the data lines extend parallel to the third and fourth edges of the substrate, and wherein the gate lines extend parallel to the first and second edges of the substrate.

* * * * *